United States Patent [19]

Phillips et al.

[11] 4,171,988

[45] Oct. 23, 1979

[54] POLYMERS FOR PREVENTING AND REMOVING SCALE IN BOILERS

[75] Inventors: Kenneth G. Phillips, River Forest; James F. Kneller, LaGrange Park, both of Ill.

[73] Assignee: Nalco Chemical Company, Oak Brook, Ill.

[21] Appl. No.: 919,533

[22] Filed: Jun. 26, 1978

Related U.S. Application Data

[63] Continuation-in-part of Ser. No. 836,254, Sep. 23, 1977, abandoned, which is a continuation of Ser. No. 769,991, Feb. 18, 1977, abandoned.

[51] Int. Cl.[2] ..... B08B 3/08

[52] U.S. Cl. ..... 134/22 R; 210/58; 252/82; 252/180; 525/403; 525/523

[58] Field of Search ..... 134/22 R; 260/29.2 EP; 252/82, 180; 210/54 R, 54 C, 58; 528/404

[56] References Cited

U.S. PATENT DOCUMENTS 3,989,636 11/1976 Domba ..... 252/180

*Primary Examiner*—Marc L. Caroff

*Attorney, Agent, or Firm*—John G. Premo; Robert A. Miller

[57] ABSTRACT

Water-soluble ampholytic polymers formed by reacting a chloroacetic acid with ammonia epichlorohydrin copolymers are useful for preventing and removing scale from boilers.

6 Claims, No Drawings

POLYMERS FOR PREVENTING AND REMOVING SCALE IN BOILERS

This is a continuation-in-part of application Ser. No. 836,254, filed Sept. 23, 1977, which was a continuation of application Ser. No. 769,991, filed Feb. 18, 1977; both now abandoned.

INTRODUCTION

This invention is concerned with reduction and removal of scale in steam boilers. More specifically, this invention is concerned with the prevention and removal of scale in evaporators, feedwater heaters, economizers, boilers and other parts of steam generating systems.

A troublesome problem encountered in steam boilers where water is boiled at superatmospheric pressures to generate steam is the tendency of such water containing any hardness constituents to deposit this hardness on the heat exchanging surfaces in the form of scale. Such scale deposition tends to reduce the heat transfer across the heat exchanging surface which increases the tendency of the metal to overheat. A most serious aspect of this problem is the rupture of boiler heat exchange surfaces as an eventual result of the scale deposition.

A number of prior art materials have been suggested to remove and particularly to inhibit boiler scale. Such materials as tannins, modified lignins, algins and other organic substances of relatively complex molecular configuration have been employed. These materials, while useful, have one or more deficiencies. For example, their use may result in boiler oxidation, metal surface decomposition and undesirable coloring which may result in steam contamination by carryover. In some instances known boiler additives must be used in relatively large and often uneconomical amounts to effectively inhibit scale.

It, therefore, becomes an object of the invention to provide a novel process of both removing and inhibiting scale formation in boilers.

Another object of the invention is to provide a new class of boiler scale preventing compositions which are useful for treatment of a wide variety of different scale-inducing materials.

THE INVENTION

In accordance with the invention, it has now been found that water-soluble ampholytic polymers formed by reacting chloroacetic acid with a cationic polymer formed by reacting epichlorohydrin and ammonia are effective in removing and inhibiting calcium formation in boilers under conditions in which steam is generated under pressures ranging from 15 p.s.i. up to about 1500 p.s.i. In the broadest aspects of the invention, sufficient polymer is added to the boiler water to accomplish the removal and inhibition of undesirable scale.

In the practice of the invention, the ampholytic polymers may be added either to the boiler feedwater or directly to the water in the boiler where the steam is generated. It is greatly preferred that the boiler water from which the steam is generated has a pH within the range of 9 to 12 and, more preferably, 9 to 11. It has been determined that the dosage range to accomplish the objects of the invention would preferably be at least 0.1 p.p.m. and, most preferably, 0.1–1000 p.p.m.

The boiler additives of the invention may be added in solution form or in solid form such as in the shape of briquettes which may also contain soda ash, phosphates or other materials to be added to the water for specific purposes. In the most preferred practice, to accomplish close additive control, the polymers are added in aqueous solution form wherein the active ingredient comprises from about 10% up to the maximum of solubility of the polymer in water.

In some instances, an alkaline material such as, for example, caustic soda, sodium carbonate or an alkaline phosphate may be required to adjust the boiler water to within the desired pH range.

The Ampholytic Water-Soluble Polymers

The polymers are prepared by first synthesizing a copolymer of epichlorohydrin and ammonia. These two ingredients are reacted in an aqueous media in a mole ratio of epichlorohydrin to ammonia of from 1:1 to 1:4 for a period of time sufficient to form a water-soluble polymer. In a preferred embodiment, a copolymer containing epichlorohydrin and ammonia in a mole ratio of 1:2 will be used.

This reaction is usually conducted by adding the epichlorohydrin to the ammonia which is in the form of an aqueous solution. The reaction is usually commenced at about room temperature and maintained within the temperature range of about 30°–60° C. Usually cooling is required to maintain the temperature in the ranges specified during the initial reaction. The reaction is conducted for a period of several hours until a somewhat viscous resinous solution is obtained.

After the epichlorohydrin-ammonia copolymer is prepared, it is then reacted with between 0.5 and 2.0 moles of chloroacetic acid based on the primary nitrogen content of the polymer. Good results are achieved when the molar quantity of chloroacetic acid is about 1 mole. In a preferred embodiment, about 2 moles of chloroacetic acid is used. To prevent salt formation, the chloroacetic acid is used in the form of its alkali metal, preferably its sodium salt.

The chloroacetic acid is slowly added to the resinous polymer solution and then the reaction temperature is maintained at about 50° C. for several hours or until the evolution of hydrochloric acid is completed.

To illustrate the preparation of a typical polymer used in the practice of the invention, Examples 1A & B and 2A & B are set forth below:

EXAMPLE 1

A. Copolymer preparation

To a one liter resin flask fitted with reflux condenser, attached dry ice condenser, stirrer thermometer, Claisen adapter and 125 ml. pressure equalized dropping funnel was added concentrated ammonium hydroxide solution (117.24 g. of 29% $NH_3$ solution, 2.0 moles). To the ammonia solution, with stirring, was added epichlorohydrin (185 g., 2.0 moles) from the dropping funnel. The addition was carried out over one hour, starting at room temperature (20° C.) and allowing the reaction temperature to rise to 35°–40° C. where it was maintained using ice bath cooling while the first two-thirds of the epichlorohydrin was added. The remaining one-third was added allowing the temperature to rise to 50°–55° C. Upon completion of the addition of epichlorohydrin, cooling of the reaction was stopped and the temperature rose to a maximum of 57° C. before the exotherm began to subside. Stirring was continued for approximately one hour until the temperature had reached 40° C. The pH of the reaction mixture was 9–10 (pH paper) at this point. The reaction mixture was then reheated to 50°-60° C. for two and one-half hours while checking the pH periodically until pH7 was reached and the reaction mixture began to get more viscous. Heating was stopped at this point, 50 ml. of deionized water was added and the reaction was cooled in an ice bath and was left to stand overnight.

B. Carboxymethylation reaction

Half of the polymer reaction mixture from the above preparation was removed from the reaction flask. The remainder of the reaction mixture (176 g.) was assumed to contain one mole of polymer secondary amine units. The pH of this polymer solution was adjusted to approximately pH 9 (pH paper) using 50% sodium hydroxide (10.6 g.) while keeping the solution cool with an ice bath. To this polymer solution, without cooling, was added all at once a solution of sodium chloroacetate (minimum 90% purity, 116.5 g., 1.0 mole) dissolved in 150 ml. of deionized water. The pH of the sodium chloroacetate solution had been adjusted from 4.8 to 7.4 using 50% sodium hydroxide (3.8 g). The reaction mixture was stirred at room temperature for 1.5 hours while the pH changed slightly from 9 to 8-9 (pH paper). At this point the reaction mixture was heated up to approximately 50° C. in one-half hour and was held at 50°-55° C. for 2.25 hours longer. During this time, the pH dropped to pH 6.7. After allowing the reaction mixture to cool overnight, the pH was approximately 6 and the reaction mixture had not gelled. Sodium bicarbonate was then added slowly (30.9 g., 0.36 mole) until the solution reached pH7 and then 50% sodium hydroxide (12.6 g., 0.16 mole) was added to reach pH 8-9 (paper) while holding the reaction mixture at 30° C., or less with ice bath cooling. Salts that had precipitated during neutralization (22 g.) were filtered off to leave 480 g. of slightly colored solution. Assuming complete reaction and a simple N-carboxymethyl-1-amino-2-hydroxypropyl repeating unit, the concentration of product is 31.9%.

C. Evaluation

The test equipment used in the following test runs consists of a No. 2 inclined tube experimental boiler with natural thermal circulation. Volume at normal operating level was 0.56 gallon. The water level itself was automatically controlled by 3 insulated electrodes which made contact with the boiler water to operate relays which controlled the feedwater pump and heating element. Pressure control was by manual adjustment of a needle valve in the condensed steam line. Boiler test specimens were low carbon steel tubes, 1½" O.D.×10" long, closed at one end and flanged at the other. The tubes were bolted in the boiler at an angle of 30° from the horizontal with the closed end down. Heat was applied to the inside and water surrounded the outside. A soft corrugated copper gasket was used to seal the tube in the boiler. The test surface itself was cleaned and polished with No. 3/0 emery paper before each test. Tests were run in absence of chemical (blank) and in a comparative manner with varying dosages of test chemical. Percent scale prevention was then calculated by measuring deposition of scale upon the test specimen with benefit of chemical boiler additive, while using the blank run as a basis of comparison and a base of 0% reduction.

The water used as test medium was 1 part Chicago tap water diluted with 8 parts zeolite softened Chicago tap and 11 parts distilled water to give a feedwater having a 5 p.p.m. calcium and 2 p.p.m. magnesium hardness. This feedwater also contained sufficient natural alkalinity to give a hydroxyl alkalinity residual of 300-350 in the boiler water (pH 10-11). Lastly, soluble phosphate salt was added in an amount sufficient to give a 3 p.p.m. $PO_4$ level. The above described test water was used unless otherwise stated.

The ampholytic polymer prepared in Example 1A was tested as a scale inhibitor at pressures ranging from 250 up to 600 lbs. per square inch at varying dosages. The results of these tests are set forth below in Table I.

TABLE I

| Test No. | PSIG | ppm (active) | Scale Prev. % |
|---|---|---|---|
| 1 | 600 | 4.0 | 65 |
| 2 | 600 | 4.0 | 65 |
| 3 | 600 | 0.4 | 45 |
| 4 | 600 | 20.0 | 0 |
| 5 | 250 | 4. | 80 |
| 6 | 1200 | 4. | 80 |

From the above, it is obvious that the ampholytic polymers of the invention are capable of preventing scale at extremely low dosages. The results set forth in Test No. 4 are incapable of explanation, but are believed to be due to experimental error.

EXAMPLE 2

A. Copolymer Preparation

An ammonia-epichlorohydrin copolymer containing ammonia and epichlorohydrin in the molar ratio of 2:1 was prepared as follows: 28% aqueous ammonia or anhydrous liquid ammonia and epichlorohydrin in a molar ratio of 1:2 were reacted in an autoclave pressure reactor. The autoclave was evacuated before making the initial charge in order to minimize autogenous pressures.

The epichlorohydrin and ammonia were metered into the autoclave over a 2-4 hour period. The autoclave was sealed and the reaction continued for a total period of 6 hours at 80° C.±10° C. The product was then cooled and discharged from the autoclave. Excess crystallized ammonium chloride was removed from products containing more than 50% solids by vacuum filtration.

B. Carboxymethylation Reation

The resulting epi-ammonia copolymer was carboxymethylated as described in Example 1 except that an excess of chloroacetic acid was used. NMR analysis later showed that about 1.7 moles of chloroacetic acid actually combined with the polymer.

C. Evaluation

A chelation test was then run to evaluate the product. The chelation test requires titration of a sample of the carboxymethylated product with a solution of calcium salt in the presence of oxalate ion at a pH of about 11.0. The polymer complexes the calcium until an excess of calcium is present whereupon the end point is indicated by the appearance of a white calcium oxalate precipitate.

The chelation procedure entailed weighing a sample of about 10 millimoles of chelating agent into a 250 ml flask and then adding 85 ml of distilled water and 5 ml of saturated ammonium oxalate solution. The ammonium oxalate solution is made by dissolving about 60 grams of reagent grade ammonium oxalate in a liter of hot water which is then allowed to cool to room temperature.

The polymeric chelant is then titrated to the first permanent turbidity with standard calcium chloride. This standard calcium chloride is made by dissolving 50.05 grams of primary standard calcium carbonate in 300 ml of distilled water by slowly adding 86 ml of concentrated hydrochloric acid to completely dissolve the carbonate. This solution is then heated to boiling to remove carbon dioxide and to completely dissolve this mixture. The solution is then cooled to room temperature and the excess acid is neutralized with ammonium hydroxide to produce a slightly alkaline solution which is then diluted to 1 liter.

After the first permanent turbidity is reached, the pH of the solution was checked and if it was below 11.0, ammonium hydroxide solution was added to raise the pH above 11.0. If the additional ammonium hydroxide dissolved the initial precipitate, the titration was now completed.

The chelation value is determined by the following formula:

$$\frac{(\text{ml } CaCL_2 \text{ sol.}) \times 50}{(\text{grams of sample})} = \text{mg. } CaCO_3/\text{gram of chelating agent} = \text{chelation value}$$

A chelation value about 200 was obtained in the present circumstance. This indicates that the polymeric material is an excellent chelating agent.

We claim:

1. A water-soluble ampholytic polymer formed by reacting 0.5 to 2.0 moles of chloroacetic acid with a condensation polymer formed by reacting epichlorohydrin and ammonia in molar ratios of epichlorohydrin to ammonia ranging from 1:1 to 1:4.

2. The ampholytic polymer of claim 1 wherein the condensation polymer of claim 1 is formed by reacting epichlorohydrin and ammonia in a molar ratio of 1:2.

3. The ampholytic polymer of claim 1 wherein about 2.0 moles of chloroacetic acid are reacted with the condensation polymer.

4. A method of removing and inhibiting scale formation in boilers in the generation of steam from boiling water which has a tendency to form scale which comprises incorporating with said water from which said steam is generated under pressures ranging from about 15 p.s.i. to about 1500 p.s.i. an amount of the ampholytic polymer of claim 1 effective to remove or inhibit said scale formation.

5. The method of claim 4 wherein the pH of the boiling water is at least 9.0.

6. The method of claim 4 wherein the ampholytic polymer is present in said water in an amount of at least 0.1 ppm.

* * * * *